US009528783B2

(12) United States Patent
Beaty

(10) Patent No.: US 9,528,783 B2
(45) **Date of Patent: *Dec. 27, 2016**

(54) BOLT CARRIER WITH INTEGRAL ADJUSTABLE GAS KEY

(71) Applicant: David L. Beaty, Mesa, AZ (US)

(72) Inventor: David L. Beaty, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/257,766

(22) Filed: Apr. 21, 2014

(65) Prior Publication Data

US 2015/0226502 A1 Aug. 13, 2015

Related U.S. Application Data

(63) Continuation-in-part of application No. 13/969,167, filed on Aug. 16, 2013.

(51) Int. Cl.
*F41A 5/28* (2006.01)
*F41A 3/26* (2006.01)
*F41A 5/24* (2006.01)

(52) U.S. Cl.
CPC .. *F41A 5/28* (2013.01); *F41A 3/26* (2013.01); *F41A 5/24* (2013.01)

(58) Field of Classification Search
CPC ..... F41A 5/18; F41A 5/20; F41A 5/22; F41A 5/24; F41A 5/26; F41A 5/28
See application file for complete search history.

(56) References Cited

U.S. PATENT DOCUMENTS

| | | | | |
|---|---|---|---|---|
| 1,366,863 | A * | 1/1921 | Berthier | F41A 3/32 89/193 |
| 3,968,727 | A * | 7/1976 | Hyytinen | F41A 5/28 89/191.02 |
| 4,244,273 | A * | 1/1981 | Langendorfer, Jr. | F41A 5/28 89/193 |
| 4,947,730 | A * | 8/1990 | Byron | F41A 5/24 89/146 |
| 5,272,956 | A * | 12/1993 | Hudson | F41A 5/28 42/72 |
| 6,848,351 | B1 * | 2/2005 | Davies | F41A 3/94 89/191.01 |
| 7,461,581 | B2 * | 12/2008 | Leitner-Wise | F41A 3/12 89/191.01 |
| 8,371,209 | B2 | 2/2013 | Boutin, Jr. | |
| 8,528,458 | B2 * | 9/2013 | Windauer | F41A 5/26 89/193 |

(Continued)

*Primary Examiner* — Troy Chambers
*Assistant Examiner* — Bridget Cochran
(74) *Attorney, Agent, or Firm* — Schmeiser, Olsen & Watts LLP

(57) ABSTRACT

A bolt carrier with integral adjustable gas key for use with a firearm is provided. The adjustable gas key includes a base portion and a tube portion coupled to the base portion. An inlet passage extends through the tube portion and an outlet passage angled from the inlet passage exits through the base portion. The adjustable gas key includes an inner volume located at a junction of the inlet passage and the outlet passage. The adjustable gas key also includes an adjustment device operatively coupled to the adjustable gas key, wherein the adjustment device adjusts a size of the inner volume. The adjustable gas key is integral and unitary with a bolt carrier of the firearm, wherein adjustment of the size of the inner volume adjusts the force of action of the bolt carrier.

9 Claims, 7 Drawing Sheets

(56) References Cited

U.S. PATENT DOCUMENTS

| | | | | |
|---|---|---|---|---|
| 2005/0223613 | A1* | 10/2005 | Bender | F41A 5/24 42/16 |
| 2014/0076143 | A1* | 3/2014 | Hall | F41A 19/03 89/129.01 |
| 2014/0076144 | A1* | 3/2014 | Gomez | F41A 3/38 89/132 |
| 2014/0083286 | A1* | 3/2014 | Gomez | F41A 5/18 89/193 |
| 2014/0318361 | A1* | 10/2014 | Larue | F41A 5/24 89/193 |
| 2015/0176933 | A1* | 6/2015 | Adams | F41A 5/28 89/191.02 |
| 2015/0241149 | A1* | 8/2015 | McMillen, IV | F41A 5/28 89/193 |

* cited by examiner

BOLT CARRIER WITH INTEGRAL ADJUSTABLE GAS KEY

CROSS REFERENCE TO RELATED APPLICATION[S]

This application is a continuation-in-part of the earlier U.S. Utility Patent Application entitled "Adjustable Gas Key," Ser. No. 13/969,167, filed Aug. 16, 2013, now pending, the disclosure of which is hereby incorporated entirely herein by reference.

BACKGROUND OF THE INVENTION

Technical Field

This invention relates generally to a bolt carrier and more particularly to a bolt carrier with an integral adjustable gas key for use with a firearm.

State of the Art

Particular firearms, such as an AR15, utilize a gas-operation system. A gas-operation system is a system of operation used to provide energy to operate auto loading firearms. In gas-operation, a portion of high pressure gas from the cartridge being fired is used to power a mechanism to extract the spent case and chamber a new cartridge. Energy from the gas is harnessed through either a port in the barrel or trap at the muzzle. This high-pressure gas impinges on a surface such as a piston head to provide motion for unlocking of the action, extraction of the spent case, ejection, cocking of the hammer or striker, chambering of a fresh cartridge, and locking of the action.

Conventional systems do not provide a mode of adjusting the force of the gas-operation system, or the blow back force when the firearm is fired. Accordingly, there is a need for a system to adjust the force of the gas-operation system.

DISCLOSURE OF THE INVENTION

The present invention relates to a gas key a bolt carrier and more particularly to a bolt carrier with an integral adjustable gas key for use with a firearm.

An embodiment includes a bolt carrier for use with a firearm. The bolt carrier comprises an adjustable gas key integral with the bolt carrier. The adjustable gas key includes a base portion and a tube portion coupled to the base portion, wherein an inlet passage extending through the tube portion and an outlet passage angled from the inlet passage, wherein the outlet passage exits through the base portion. The adjustable gas key further includes an inner volume located at a junction of the inlet passage and the outlet passage. Additionally, the adjustable gas key includes an adjustment device operatively coupled to the adjustable gas key, wherein the adjustment device adjusts a size of the inner volume.

Another embodiment includes a firearm with a bolt carrier. The firearm includes a firearm utilizing a gas-operated system, the firearm comprising an upper receiver, a lower receiver and a gas tube extending from a gas block coupled to the barrel to a bolt carrier. The bolt carrier also includes an adjustable gas key integral with the bolt carrier. The adjustable gas key includes a base portion; a tube portion coupled to the base portion, the tube portion engaging the gas tube, wherein an inlet passage extending through the tube portion and an outlet passage angled from the inlet passage, wherein the outlet passage exits through the base portion, such that propellant gas produced by firing the firearm is directed through the gas tube and through the inlet passage and exits through the outlet passage; an inner volume located at a junction of the inlet passage and the outlet passage; and an adjustment device operatively coupled to the adjustable gas key, wherein the adjustment device adjusts a size of the inner volume.

Another embodiment includes a method of using an adjustable gas key. The method includes the steps of operatively coupling a bolt carrier with an integral adjustable gas key between an upper receiver and lower receiver of a firearm; adjusting an adjustable device of the adjustable gas key, wherein a size of an inner volume of the adjustable gas key is adjusted in response to adjusting the adjustable device; testing operation of the firearm to determine correct firing and discharge of the expended shell; and partially disengaging the upper receiver from the lower receiver to adjust the adjustment device in response to an improper firing or discharge of the expended shell of the firearm.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, the Figures are not necessarily drawn to scale, and:

DETAILED DESCRIPTION OF EMBODIMENTS OF THE INVENTION

Gas-operated firearms have various types of ammunition that can be utilized by the firearm and further ammunition is produced by various manufacturers. This ammunition by different manufacturers results in varied amounts of gas that runs from a gas block to the gas key in order to operate the bolt carrier of the firearm. Further, other causes of varied amounts of gas that runs from the gas block to the gas key include the use of suppressors, which create more back pressure and the manufacturing of a gas port that is too big. Additionally, gas may be varied because of worn parts, such as gas rings, as well as leaks in the gas system, such as between the gas key and the bolt carrier and the between the gas block and the gas tube. Because of the varied amounts of gas, there is a need to adjust the system in order for the firearm to operate correctly.

Existing systems try to adjust the gas flowing to the gas key by using adjustable gas blocks or by adjusting the dimensions of the gas tube. These systems are time consuming and difficult to install and adjust because it requires the dismantling of the firearm. Exposure to the adjustable feature of the gas block may be limited, and further are not applicable to every firearm. Accordingly, a new and improved means of adjusting the gas is needed.

As discussed above, embodiments of the present invention relate to an adjustable gas key for use with a bolt carrier of a firearm. Specifically, the adjustable gas key can be utilized to replace a conventional existing gas key and operate the firearm properly. Embodiments of the adjustable gas key are particularly useful in systems that utilize a direct impingement method of operation that vents gas through a tube to the working parts of a rifle where they directly impinge on the bolt carrier. In direct impingement systems, the propellant gas produced by firing a round is blown directly into the action parts and engages the gas key to recoil the bolt carrier. As discussed previously, the type of ammunition and manufacturer, use of suppressors and gas port placement and size can result in varying amounts of propellant gas that moves through the gas tube to the gas key and can easily result in unreliable operation of the firearm, including a short stroke or other issues that affect whether the expired shell is properly ejected from the firearm.

Figure 1:
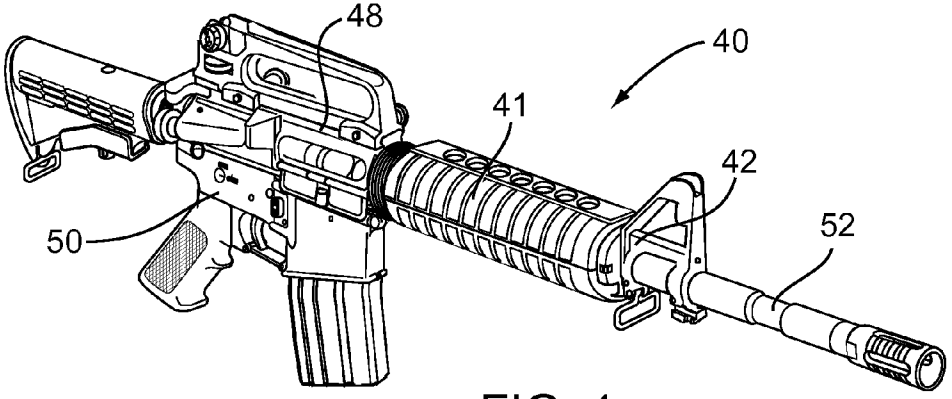
FIG. 1 is a perspective view of a firearm having a gas-operated system.
Figure 2:
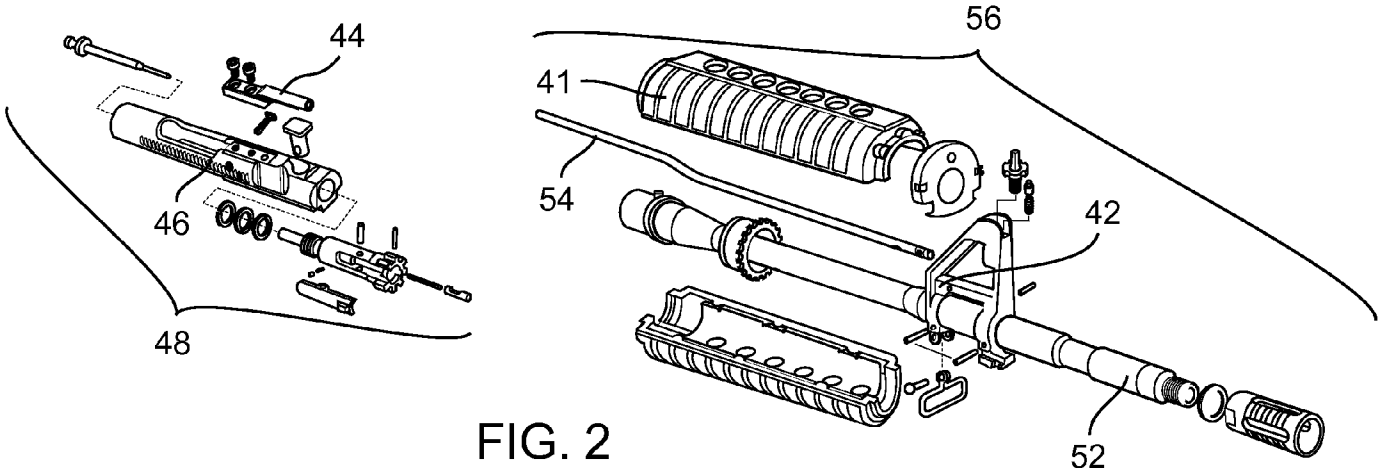
FIG. 2 is a perspective exploded view of a bolt carrier, a conventional gas key, and a barrel/hand guard assembly.
Figure 3:
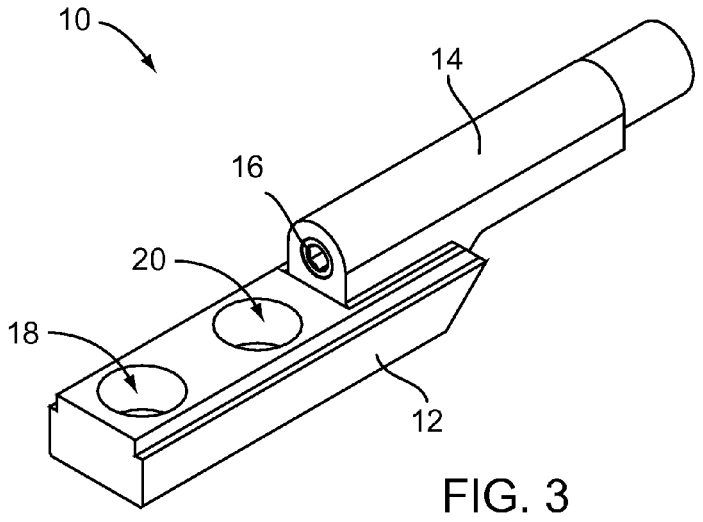
FIG. 3 is a perspective view of an adjustable gas key.
Figure 4:
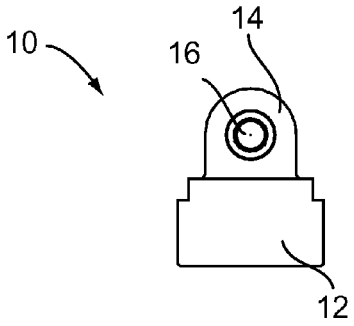
FIG. 4 is back view of an adjustable gas key.
Figure 5:
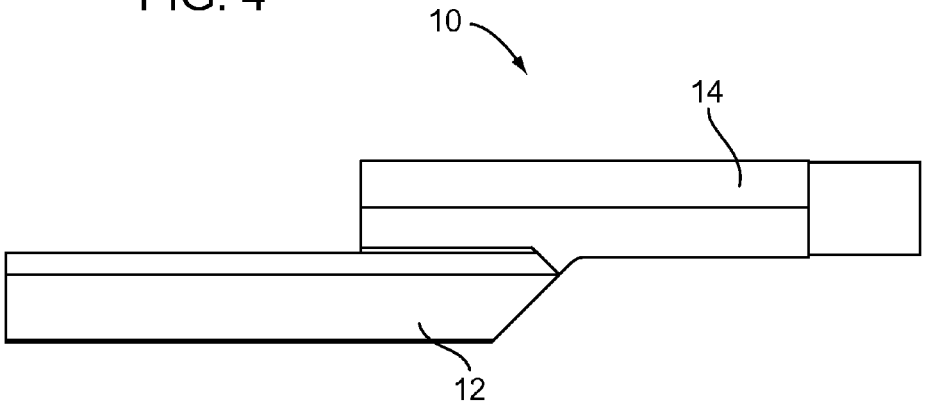
FIG. 5 is a side view of an adjustable gas key.
Figure 6:
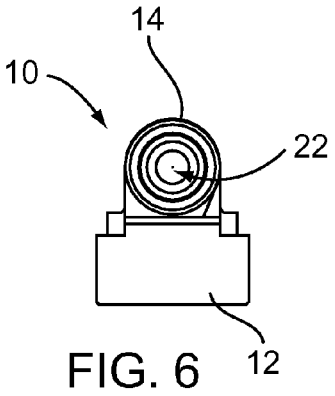
FIG. 6 is front view of an adjustable gas key.
Figure 7:
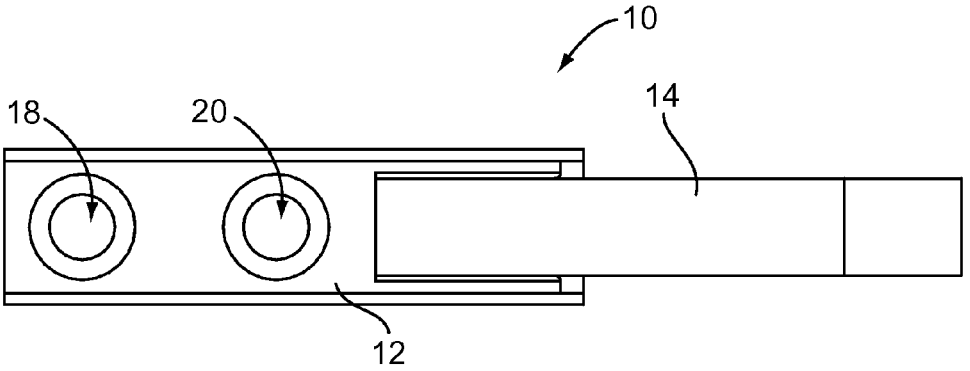
FIG. 7 is a top view of an adjustable gas key.
Figure 8:
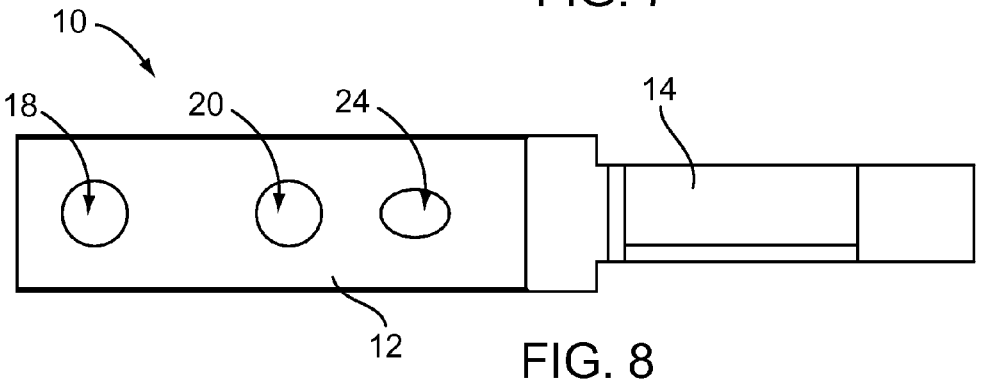
FIG. 8 is a bottom view of an adjustable gas key.

Referring to FIGS. 1 and 2, a firearm 40 is shown wherein embodiments of the present invention can be used within. Generally speaking, among many components, a firearm 40 includes and upper receiver 48; a lower receiver 50; barrel/hand guard assembly 56 having a gas block 42, a gas tube 54 and a barrel 52; and a bolt carrier assembly 48 having a bolt carrier 46 and a gas key 44. The gas tube 54 engages a gas key 44 that may be coupled directly to the bolt carrier 46 in order for the firearm to operate correctly. It is understood that while a FIGS. 1 and 2 depict a firearm 40 with a gas block 42 that also serves as a site tower, other gas blocks 42 are common that do not include a site tower. Further, often times the hand guard 41 encloses the gas block 42, wherein the gas block is not accessible unless the hand guard 41 is removed from the firearm 40.

Referring again to the drawings, FIGS. 3-9 depict an adjustable gas key 10, wherein according to embodiments of the present invention adjustable gas key 10 replace gas key 44 depicted in FIG. 2. Adjustable gas key 10 includes a base portion 12 having apertures 18 and 20, wherein apertures 18 and 20 correspond to holes in the bolt carrier 46. Fastening devices, such as screws, may engage the holes in the bolt carrier while extending through the holes. These fastening devices removably couple the adjustable gas key 10 to the bolt carrier. The adjustable gas key 10 further includes a tube portion 14. The tube portion 14 engages a gas tube that extends from the gas block to the bolt carrier.

The adjustable gas key 10 further includes an adjustment device 16. In some embodiments the adjustment device 16 includes, but is not limited to an adjustment screw, a valve, such as a ball valve, or the like. The turning of the adjustment screw in one direction or the other results in the adjustment of the amount of gas that flows through the adjustable gas key 10.

Figure 9:
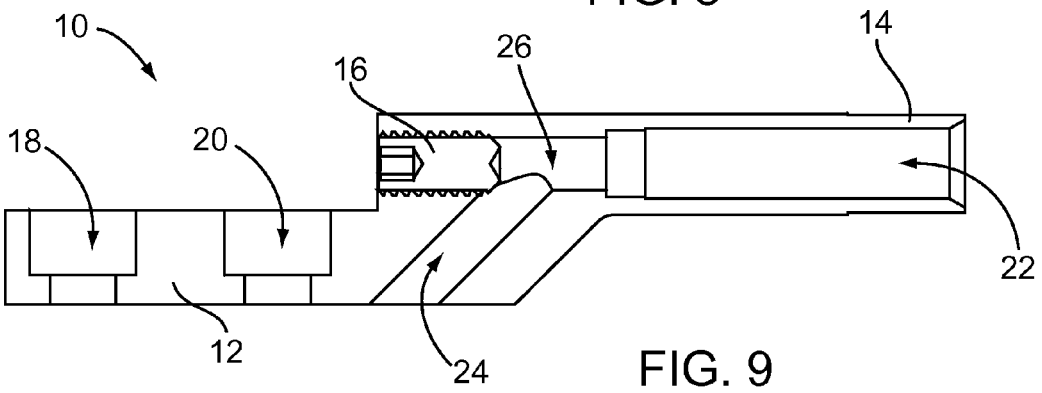
FIG. 9 is a section view of an adjustable gas key.

Referring specifically to FIG. 9 depicts an inner tube having an inlet passage 22 extending through the tube portion 14 to outlet passage 24 extending at an angle from the inlet passage 22 to exit through a bottom side of the base portion. The inlet passage 22 connected to the outlet passage 24 forms an inner volume section 26. The adjustment device 16 engages the inner volume 26, wherein the rotation of the adjustment device 16 moves the adjustment device 16 into and out of the inner volume 26. This movement of the adjustment device 16 into and out of the inner volume 26 adjusts the size of the inner volume 26, which thereby adjusts the force produced by propellant gas that impinges the bolt carrier through the adjustable gas key 10. Adjusting the adjustable gas key 10 provides the ability to properly adjust the recoil of the bolt carrier to avoid cartridge or shell extractions and ejection issues and to better account for variations in the ammunition provided by a various manufacturers and other causes of variations in the production of the propellant gas.

As shown in the drawing figures, the adjustment device 16 may be aligned with the inner tube 22. However, it will be understood that the adjustment device 16 may extend at any angle from the adjustable gas key 10 so long as the adjustment device 16 engages inner volume 26 at any point along the inlet or outlet passage 22 and 24.

Locating the adjustment device 16 on the adjustable gas key 10 allows for a user to easily adjust the adjustment device 16. The bolt carrier is coupled between the upper and lower receivers 48 and 50 of a firearm. Therefore, utilizing a common two pin connection between the upper and lower receivers 48 and 50 of the firearm 40, a user can disengage a rear pin to allow access to the gas key 10 and adjust the adjustment device 16 and then engage the rear pin and fire the firearm.

Another embodiment of the present invention includes a method of using an adjustable gas key. The method includes the steps of coupling an adjustable gas key to a bolt carrier and operatively coupling the bolt carrier between an upper receiver and lower receiver of a firearm; adjusting an adjustable device of the adjustable gas key, wherein a size of an inner volume of the adjustable gas key is adjusted in response to adjusting the adjustable device; testing operation of the firearm to determine correct extraction and discharge of the expended shell; and partially disengaging the upper receiver from the lower receiver to adjust the adjustment device in response to an improper firing or discharge of the expended shell of the firearm.

In the method the adjusting the adjustment device comprises rotating the adjustment device. Further, in some embodiments, the adjustment device is an adjustment screw. Additionally, the adjusting the adjustment device comprises moving the adjustment device into and out of the inner volume.

The method further comprises adjusting the force of the recoil of the bolt carrier in response to the adjusting the adjustment device; and reengaging the upper receiver with the lower receiver after adjusting the adjustment device. The method may also include repeating the adjustment of the adjusting device until a proper ejection pattern of expired shells from the firearm is obtained.

Figure 10:
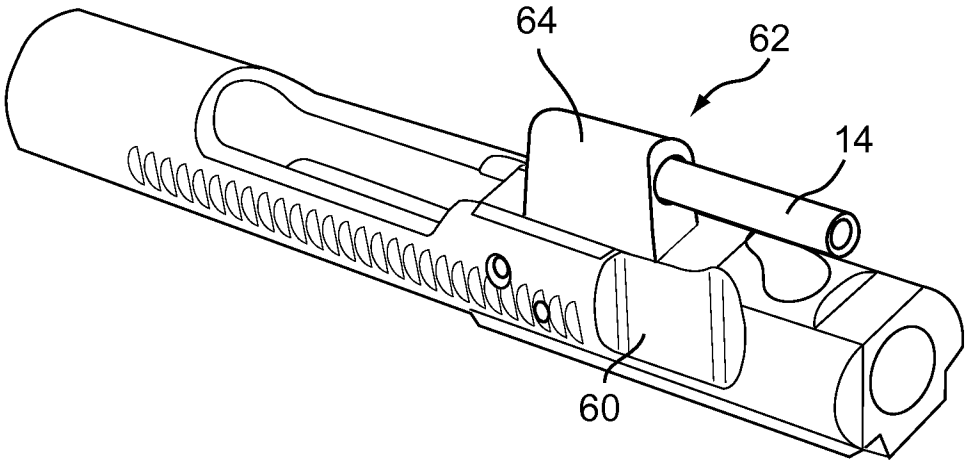
FIG. 10 is a perspective view of a bolt carrier with integral adjustable gas key.
Figure 11:
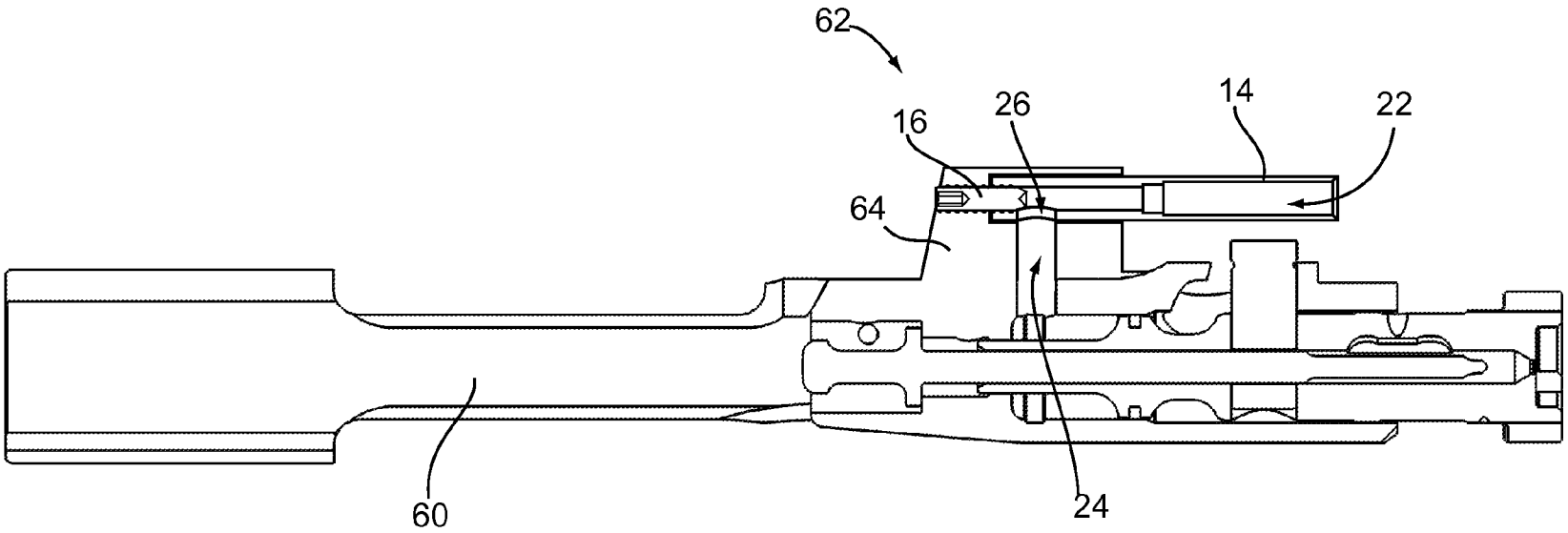
FIG. 11 is a section view of a bolt carrier with integral adjustable gas key.

In other embodiments and in reference to FIGS. 10 and 11, embodiments may include a monolithic bolt carrier 60 with an integral adjustable gas key 62. Adjustable gas key 62 includes a gas key tower 64 and a tube portion 14. The tube portion 14 is removably coupled to the gas key tower 64, wherein when the tube portion 14 is coupled to the gas key tower 64, it engages a gas tube that extends from the gas block to the bolt carrier 60.

The adjustable gas key 62 further includes an adjustment device 16. In some embodiments the adjustment device 16 includes, but is not limited to an adjustment screw, a valve, such as a ball valve, or the like. The turning of the adjustment screw in one direction or the other results in the adjustment of the amount of gas that flows through the adjustable gas key 62.

Referring specifically to FIG. 11 depicts an tube portion 14 having an inlet passage 22 extending through the tube portion 14, the inlet passage 22 being in fluid communication with outlet passage 24 extending through the gas key tower 64, when the tube portion 14 is coupled to the gas key tower 64. The inlet passage 22 connected to the outlet passage 24 forms an inner volume section 26. The adjustment device 16 is operatively coupled to the gas key tower 64, such that it engages the inner volume 26, wherein the operation of the adjustment device 16 adjusts the size of the inner volume 26, which thereby adjusts the force produced by propellant gas that impinges the bolt carrier through the adjustable gas key 62. In other embodiments, adjusting the adjustment device operates to restrict or control the amount of flow of gas through the inner volume. Adjusting the adjustable gas key 62 provides the ability to properly adjust the recoil of the bolt carrier to avoid cartridge or shell extractions and ejection issues and to better account for variations in the ammunition provided by various manufacturers and other causes of variations in the production of the propellant gas. It will be understood that the outlet passage 24 may extend at any angle from the inlet passage 22.

Figure 12:
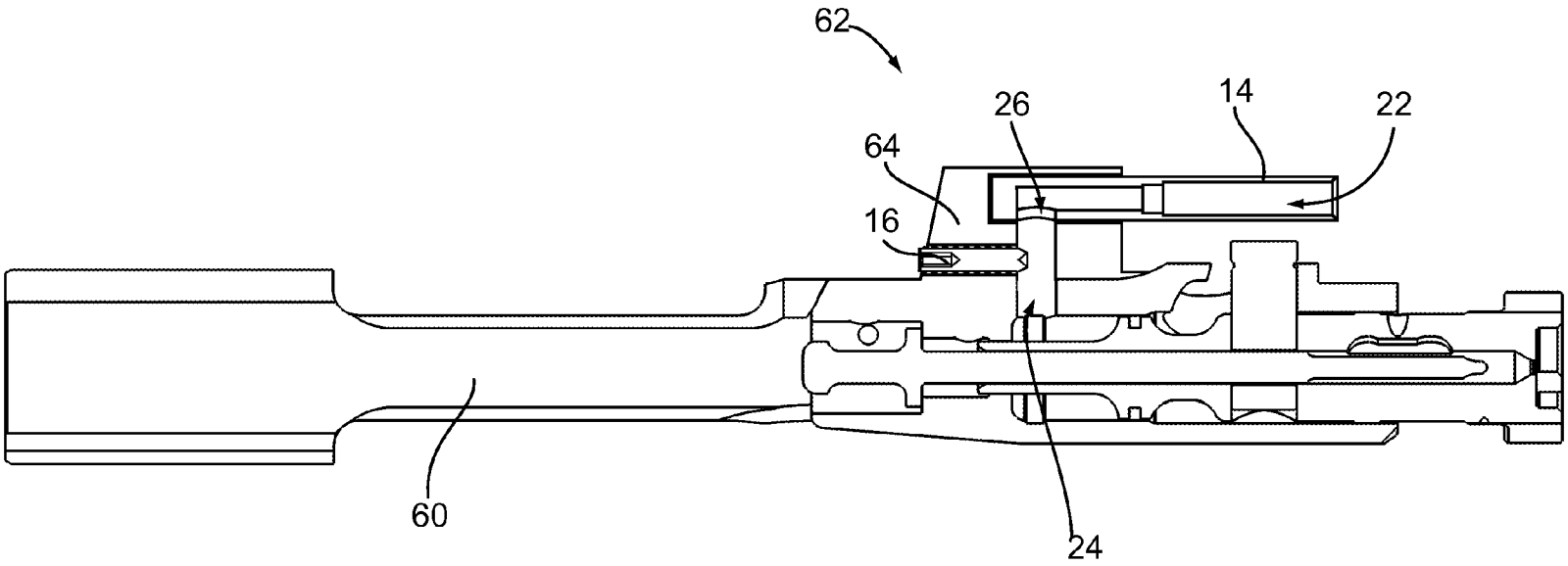
FIG. 12 is another section view of a bolt carrier with integral adjustable gas key.
Figure 13:
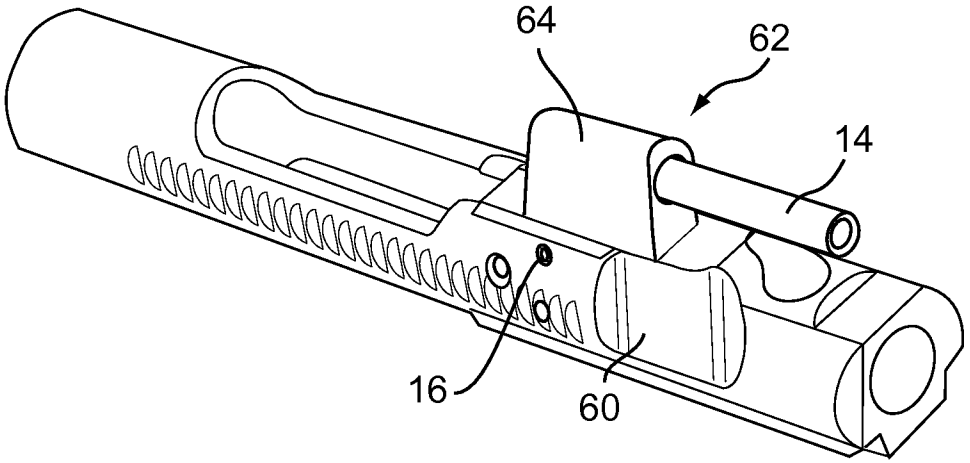
FIG. 13 is another perspective view of a bolt carrier with integral gas key.

As shown in the drawing figures, the adjustment device 16 may be aligned with the inner tube 22. However, it will be understood that the adjustment device 16 may extend at any angle from the adjustable gas key 62 so long as the adjustment device 16 engages inner volume 26 at any point along the inlet or outlet passage 22 and 24, as shown in FIGS. 12 and 13.

Locating the adjustment device 16 on the adjustable gas key 62 allows for a user to easily adjust the adjustment device 16. The bolt carrier is coupled between the upper and lower receivers 48 and 50 of a firearm. Therefore, utilizing a common two pin connection between the upper and lower receivers 48 and 50 of the firearm 40, a user can disengage a rear pin to allow access to the bolt carrier 60 with the integral adjustable gas key 62 and adjust the adjustment device 16 and then engage the rear pin and fire the firearm.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A bolt carrier use with a firearm, the bolt carrier comprising:

an adjustable gas key, wherein the adjustable gas key and the bolt carrier are a unitary body, the adjustable gas key comprising a gas key tower;

a tube portion coupled directly to the gas key tower, wherein an inlet passage extending through the tube portion and an outlet passage in fluid communication with the inlet passage, wherein the outlet passage exits through the gas key tower;

an inner volume defined by the inlet passage and the outlet passage; and an adjustment device coupled directly to the gas key tower and linearly aligned with the inlet passage, wherein the adjustment device adjusts a size of the inner volume of the junction of the inlet tube and the outlet tube.

2. The bolt carrier of claim 1, wherein the adjustment device is rotatably coupled to the gas key tower, wherein the size of the inner volume is adjusted in response to rotation of the adjustment device.

3. The bolt carrier of claim 2, wherein the adjustment device is an adjustment screw.

4. A firearm with a bolt carrier comprising:

the firearm utilizing a gas-operated system, the firearm comprising an upper receiver, a lower receiver and a gas tube extending from a gas block coupled to the barrel to the bolt carrier; and the bolt carrier having an adjustable gas key, wherein the adjustable gas key and the bolt carrier are a unitary body, the adjustable gas key comprising:

a base portion;

a tube portion coupled to the base portion, the tube portion engaging the gas tube, wherein an inlet passage extending through the tube portion and an outlet passage angled from the inlet passage, wherein the outlet passage exits through the base portion, such that propellant gas produced by firing the firearm is directed through the gas tube and through the inlet passage and exits through the outlet passage;

an inner volume defined by the inlet passage and the outlet passage; and an adjustment device coupled directly to the adjustable gas key and linearly aligned with the inlet passage, wherein the adjustment device adjusts a size of the inner volume of the junction of the inlet tube and the outlet tube to adjust a force of action of the bolt carrier.

5. The firearm of claim 4, wherein the adjustment device is rotatably coupled to the adjustable gas key, wherein the size of the inner volume is adjusted in response to rotation of the adjustment device.

6. The firearm of claim 5, wherein the adjustment device is an adjustment screw.

7. The firearm of claim 4, wherein bolt carrier is operatively coupled between the upper receiver and the lower receiver.

8. The firearm of claim 7, wherein adjustment device of the adjustable gas key is operable when the upper receiver is partially disengaged from the lower receiver.

9. A bolt carrier with a gas key for use with a firearm, the bolt carrier comprising:

the gas key coupled to the bolt carrier, wherein the bolt carrier includes an inlet passage extending through a tube portion of the gas key and an outlet passage in fluid communication with the inlet passage, wherein the outlet passage exits in the bolt carrier;

an inner volume located at the bolt carrier with the gas key, the inner volume defined by the inlet passage and the outlet passage, wherein gas flows through the inner volume; and an adjustment device, wherein the adjustment device adjusts a size of the inner volume.

* * * * *